US006178712B1

(12) United States Patent
Sauer

(10) Patent No.: US 6,178,712 B1
(45) **Date of Patent: *Jan. 30, 2001**

(54) LOCKING CONNECTION FOR CEILING GRID SYSTEM

(75) Inventor: Gale E. Sauer, Sinclairville, NY (US)

(73) Assignee: Worthington Armstrong Venture, Malvern, PA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/908,644

(22) Filed: Aug. 7, 1997

Related U.S. Application Data

(63) Continuation of application No. 08/202,638, filed on Feb. 28, 1994, now abandoned, which is a continuation of application No. 07/864,314, filed on Apr. 6, 1992, now abandoned.

(51) Int. Cl.[7] ..... E04B 9/18

(52) U.S. Cl. ..... 52/506.07; 52/667; 52/506.06; 52/769; 52/745.05

(58) Field of Search ..... 52/474, 666, 667, 52/764, 769, 773, 506.06, 506.07, 745.05; 403/347

(56) References Cited

U.S. PATENT DOCUMENTS

| | | |
|---|---|---|
| 3,193,063 | 7/1965 | Brown et al. . |
| 3,367,695 | 2/1968 | Haertel et al. . |
| 3,396,997 | 8/1968 | Adams . |
| 3,746,379 | 7/1973 | Sauer . |
| 3,922,829 | 12/1975 | Sauer . |
| 4,108,563 | 8/1978 | Brown et al. . |
| 4,161,856 | 7/1979 | Brown et al. . |
| 4,317,641 | 3/1982 | Sauer . |
| 4,364,686 | 12/1982 | Sharp et al. . |
| 4,494,350 | 1/1985 | Sharp . |
| 4,499,697 | 2/1985 | La Londe . |
| 4,549,383 | 10/1985 | Vukmanic et al. . |
| 4,601,153 | 7/1986 | Dunn et al. . |
| 4,611,453 | 9/1986 | Worley . |
| 4,621,474 | 11/1986 | Worley . |
| 4,648,230 | 3/1987 | Mieyal et al. . |
| 4,712,350 | 12/1987 | Vukmanic . |
| 4,785,603 | 11/1988 | Platt . |
| 4,827,681 | 5/1989 | Platt . |
| 4,864,791 | 9/1989 | Platt . |
| 4,912,894 | 4/1990 | Platt . |
| 4,989,387 | 2/1991 | Vukmanic et al. . |
| 5,044,138 | 9/1991 | Zaccardelli et al. . |
| 5,517,796 | 5/1996 | Koski et al. . |
| B1 4,779,394 | 9/1994 | Shirey et al. . |

FOREIGN PATENT DOCUMENTS

| | | |
|---|---|---|
| 43 40 404 | 6/1995 | (DE) . |
| 0 205 673 | 12/1986 | (EP) . |
| 0 287 254 | 5/1990 | (EP) . |
| 2 713 259 | 8/1997 | (FR) . |
| 1 435 157 | 5/1976 | (GB) . |
| 2 284 219 | 11/1993 | (GB) . |

*Primary Examiner*—Carl D. Friedman
*Assistant Examiner*—Timothy B. Kang

(57) ABSTRACT

A locking connection used to join the cross runners and main runners of a suspended grid ceiling system. The main runners are provided with periodic openings through which the cross runner ends are inserted and thereby locked together. Each cross tee end connector contains a resilient finger which engages the main runner upon insertion. Further, each connector has apertures and raised detents which will mate with those of a like opposing cross tee end connector when both are inserted through the same main runner opening. A locked grid intersection can be disengaged by depressing the resilient finger holding the main runner, rotating the main runner over the cross runner end connector, and pushing the cross tee end vertically free.

10 Claims, 4 Drawing Sheets

LOCKING CONNECTION FOR CEILING GRID SYSTEM

CROSS REFERENCES TO RELATED APPLICATIONS

This application is a continuation of application Ser. No. 08/202,638, filed Feb. 28, 1994, now abandoned; which was a continuation of application Ser. No. 07/864,314, filed Apr. 6, 1992, now abandoned.

BACKGROUND OF THE INVENTION

1. Field of the Invention

The invention relates generally to suspended grid ceiling systems which are used in supporting ceiling panels. More specifically, this invention covers an improved connection for assembling such grid systems.

2. Description of the Prior Art

Ceiling grid systems customarily comprise a plurality of parallel main runners and a plurality of parallel cross runners perpendicularly intersecting the main runners. The cross runners normally have locking connectors on each end insertable through openings in the main runners. Many of the early systems used locking connectors on the ends of the cross runners that were relatively easy to disassemble. However, these systems no longer meet many of the building codes. Building codes, to improve safety in seismic areas, have been revised to require ever higher locking tension requirements.

A new family of cross runner lock connections were designed to meet these high strength requirements as disclosed in U.S. Pat. Nos. 3,922,829; 4,108,563; 4,601,153 and 4,317,641. Their general construction entailed cross runners with like connector ends, each having a single detent and aperture. Although these connectors met the increased code requirements, these locks could not be disengaged without major distortion or destruction. This problem of trying to achieve high locking strength together with removability was addressed earlier, i.e., U.S. Pat. Nos. 4,621,474 and 4,648,230. Both of these lock designs have a removable sequence which is initiated by a lateral force. When lateral forces are applied to such cross tees, they can be withdrawn. This is a major flaw since a disengaging lateral force could be applied unintentionally when placing panels or light fixtures or by a seismic disturbance.

SUMMARY OF THE INVENTION

The object of this invention is to provide a locking connection for a grid ceiling system which has an improved tensile load capability and a practical means for disengagement.

This grid ceiling system is composed of main runners and cross runners. Each runner includes a central web with oppositely extending flanges extending from one edge. Main runners are supported from a structural ceiling and connected end to end in parallel rows across the ceiling. Main runners have periodic openings in the web designed to engage cross runner connections. Cross runners are installed in rows perpendicular to the main runners. Cross runners have connectors on each end which, during assembly, are insertable through the opening in the main runner web. Each connector has a raised resilient finger which, when inserted through a main runner opening, will prevent withdrawal of the connector. Further, each connector has two apertures. Adjacent each aperture is a raised detent positioned with the raised detent shoulders facing away from the end of the runner. When two opposing cross runner connectors have been inserted through a main runner opening, the detents of one runner pass into the apertures of the other runner. The detents of the opposing connectors, when fully engaged, form two locking elements capable of withstanding high tensile loading. A means is provided to insure full locking engagement and prevent lateral separation.

When this lock is engaged, it cannot be released unintentionally. It cannot be withdrawn with the opposing detents engaged. The opposing detents can only be disengaged vertically, and this vertical separation is not possible within the main runner opening.

A locked intersection can be released by a sequence of three steps. First depressing the resilient finger which will permit the main runner to be rotated. Then rotating the main beam over the resilient finger as far as it will go. Finally, lifting one cross tee end connector vertically so it will disengage from the other cross tee end connector.

DESCRIPTION OF THE PREFERRED EMBODIMENTS

FIGS. 1 through 7 illustrate a suspended grid ceiling system in accordance with the present invention. It should be realized that a complete grid ceiling system consists of main runners 1 and cross runners 2. These are metal runners and are formed into the shape of an inverted tee, FIG. 1, using a process such as rollforming.

Figure 1:
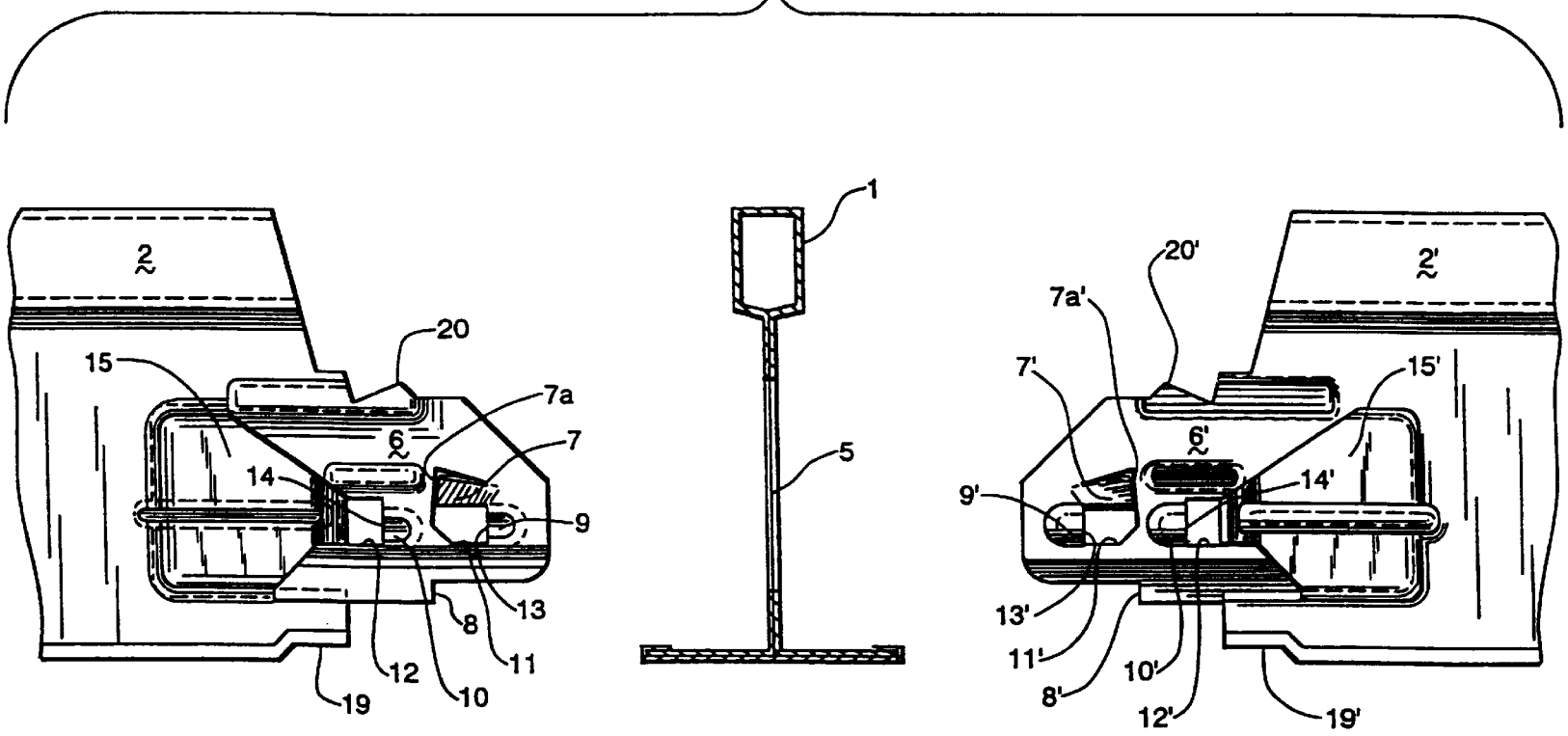
FIG. 1 is an enlarged view of a main runner opening and two cross runner end connectors before assembly.
Figure 2:
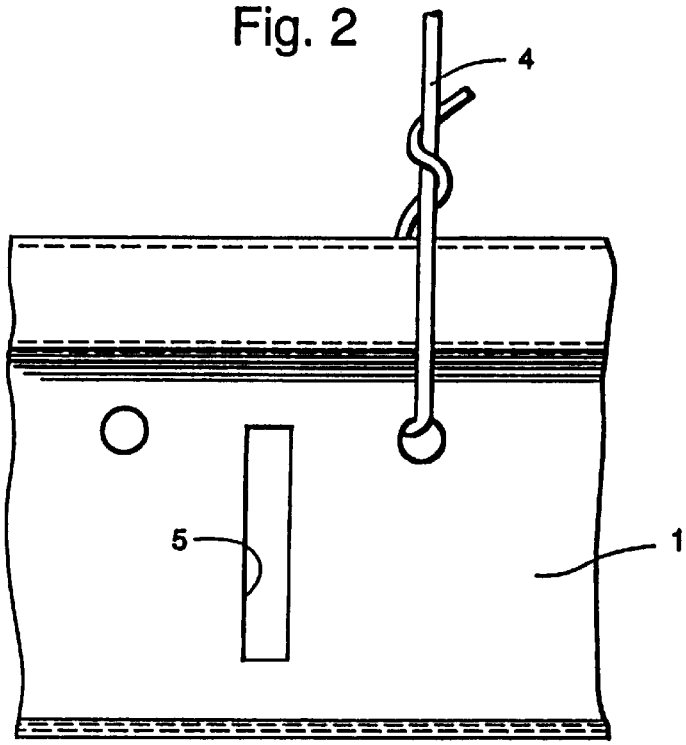
FIG. 2 is a side view of the main runner showing the shape of the connector opening.
Figure 3:
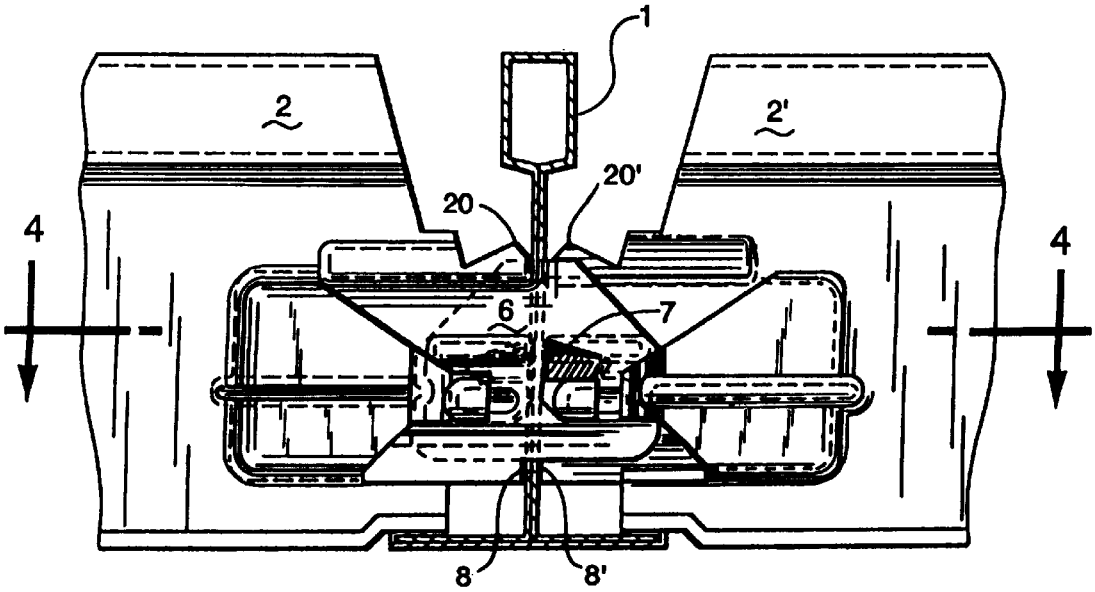
FIG. 3 is an enlarged view of a cross runner end connection fully assembled.
Figure 4:
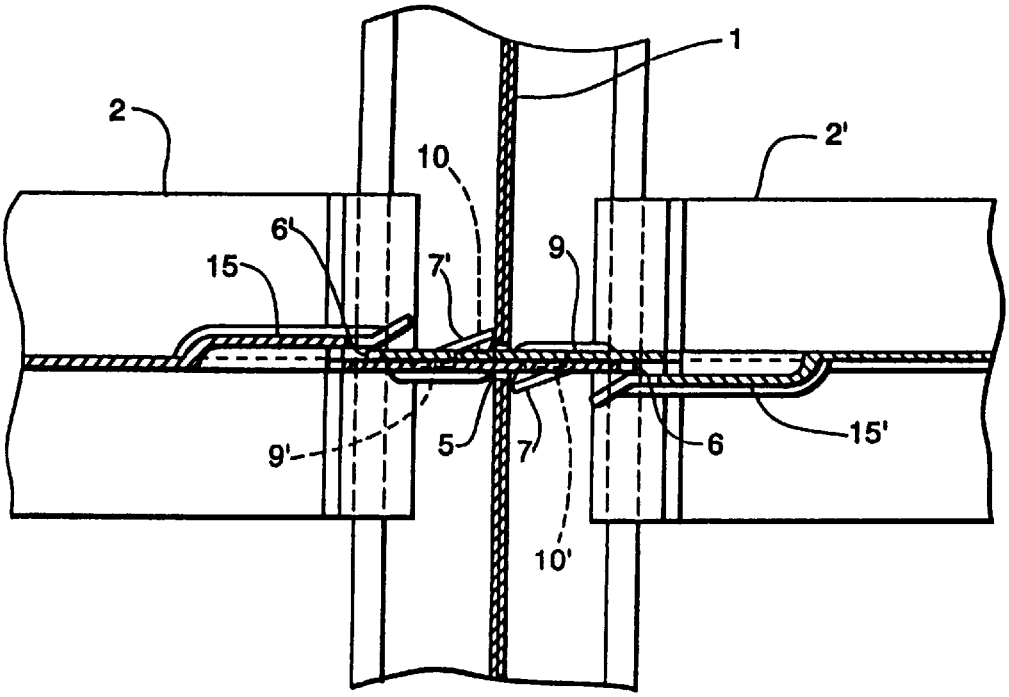
FIG. 4 is a fragmentary section taken along line 3—3 of FIG. 3.

Main runners 1 are suspended by a wire 4 from the building structural ceiling in parallel rows across the ceiling. Along the main runners 1 are periodic openings or slots 5. FIG. 2 shows a segment of main runner with a slot opening 5. Cross runners 2 are installed in parallel rows perpendicular to the main runners 1. Each cross runner 2 has a connector 6 on each end which is inserted through a main runner opening 5 during assembly. FIG. 1 shows two opposing cross runner connectors 6 and 6' and a main runner opening 5 before insertion. The connector 6 could be stamped from the web of the cross runner 2 or be an attached clip. At each grid intersection, there is a main runner 1 with two cross runner end connectors 6 locked within the same main runner opening 5. Such an intersection is shown in FIG. 3. This locked intersection of two cross runner connectors within a main runner opening 5 is the invention to be described in detail as follows.

FIG. 1 shows two identical cross runner connectors 6 and 6' opposing each other before engagement into a main runner opening 5. FIG. 3 shows the connectors 6 and 6' fully assembled. During assembly, as a connector 6 proceeds through the main runner opening 5, a resilient finger 7 with a movable shoulder 7*a*, is thereby depressed. When the cross runner connector 6' is fully inserted abutting the stop shoulder 8, the resilient finger 7 will recover and the shoulder 8 will prevent withdrawal from the main runner opening 5 by engaging the web of the main runner 1.

When a second opposing cross runner connector 6' is inserted, its resilient finger 7' will lock to the opposite side of the main runner opening 5 in the same manner as the first. In addition, the two cross runner connectors 6 and 6' will become locked to each other.

In FIG. 1, two raised detents 9 and 10, and two apertures 11 and 12 are shown. Between detent 9 and aperture 11 and between detent 10 and aperture 12 are raised shoulders 13 and 14 which face away from the lead end of the connectors 6 and 6'. When two opposing connectors are inserted into the same main runner opening 5, detents 9 and 10 will pass into apertures 12' and 11' respectively. Likewise, detents 9' and 10' will pass into apertures 12 and 11. As the two connectors 6 and 6' are so positioned, shoulders 14 and 13' are in locking abutment, and shoulders 13 and 14' are in locking abutment.

To stabilize the locking arrangement described above, a means must be used to hold the opposing connectors 6 and 6' together laterally with the locks fully engaged. One method to achieve this is a tab 15 as shown rearward on the connector 6. When opposing connectors 6 and 6' are assembled, the lead ends cam under said tab 15 and 15' the locking shoulders 14 and 13' and 14' and 13 are held in tight engagement.

Figure 5:
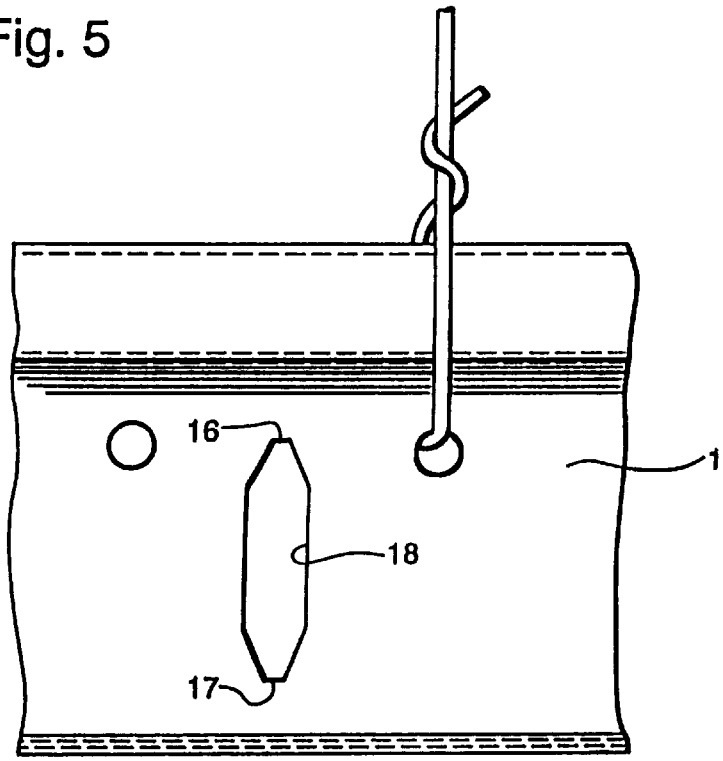
FIG. 5 shows a second embodiment of a main runner connector opening.
Figure 6:
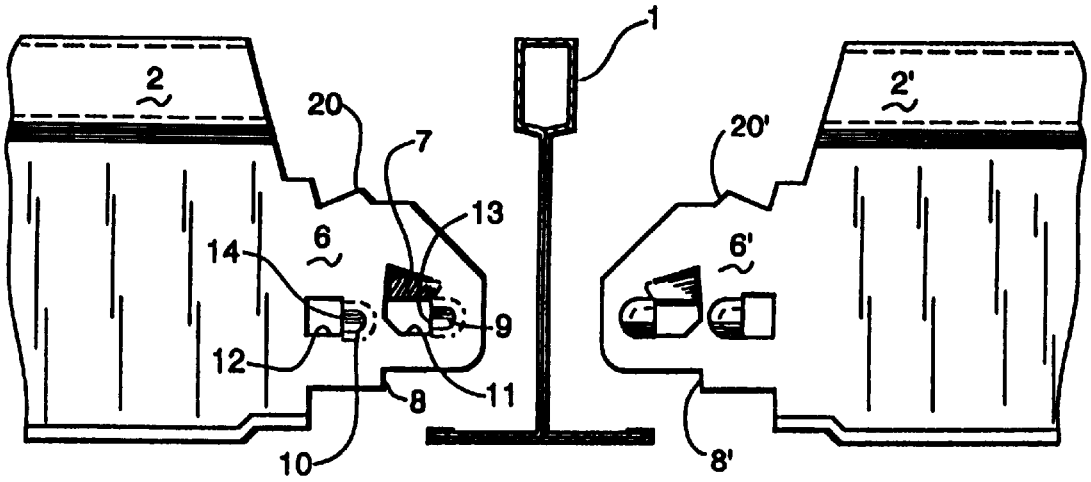
FIG. 6 shows a second embodiment of a cross tee connector.

An equivalent means to stabilize the locking arrangement is to use a main runner opening 5 as shown in FIG. 5. A lesser dimension at the top 16 and the bottom 17 of the main runner opening 5 will hold the connector locks fully engaged. The central area of the optional main runner opening 18 is dimensioned to permit the connector 6 and 6' ends to flex past each other when inserted. FIG. 6 shows cross runner connectors 6 and 6' connection without tab 15 which would be suitable for use with the optional main runner opening 18.

The use of four raised detent shoulders on a cross tee connection is a significant improvement over the use of two. This is an important feature of this invention. Comparative tension tests were conducted on two sets of cross runner end connector samples. Both sets of samples used two apertures, and both used a rearward detent with a rearward facing shoulder. Except for the following, both sets of samples were identical in every feature and dimension. The forward shoulder adjacent the aperture of the first set of samples was not raised. It was left flat. In assembly, the rearward aperture was thereby redundant. In the second set of samples, the forward shoulder was raised on a formed detent. The test results showed 28% higher tensile loads were carried by the second set of samples which used four raised shoulders.

A second important feature of this invention is that cross runners 2 can be removed from a completed ceiling. There are many reasons why this is important in maintaining a ceiling or the equipment mounted above the ceiling. Further, it is important that the removability features of a cross runner connector 6 be consistent with its high performance intent. A product cannot be specified to meet high performance code requirements and also be subject to an unintentional or accidental lock release.

The cross runner 6 removal procedure is initiated by depressing the resilient finger 7. This resilient finger 7 is so designed that it can be depressed with a finger nail. The use of a tool is not required.

It should be noted that before this resilient finger 7 is depressed, the resilient fingers 7 and 7', the stop shoulders 8 and 8', and the offset flange 19 and 19' all cooperate to entrap the main runner 1 with its web in a vertical position. Further, the main runner, by its suspension to the building structure above and urged by gravity, will hang with its web in a vertical position.

When the main runner is held vertical, its connector opening 5 will prevent the locked opposing cross runner connectors 6 and 6' from vertically bypassing each other. In this position, the connected intersection cannot be broken except by extreme forces beyond performance requirements.

Figure 7:
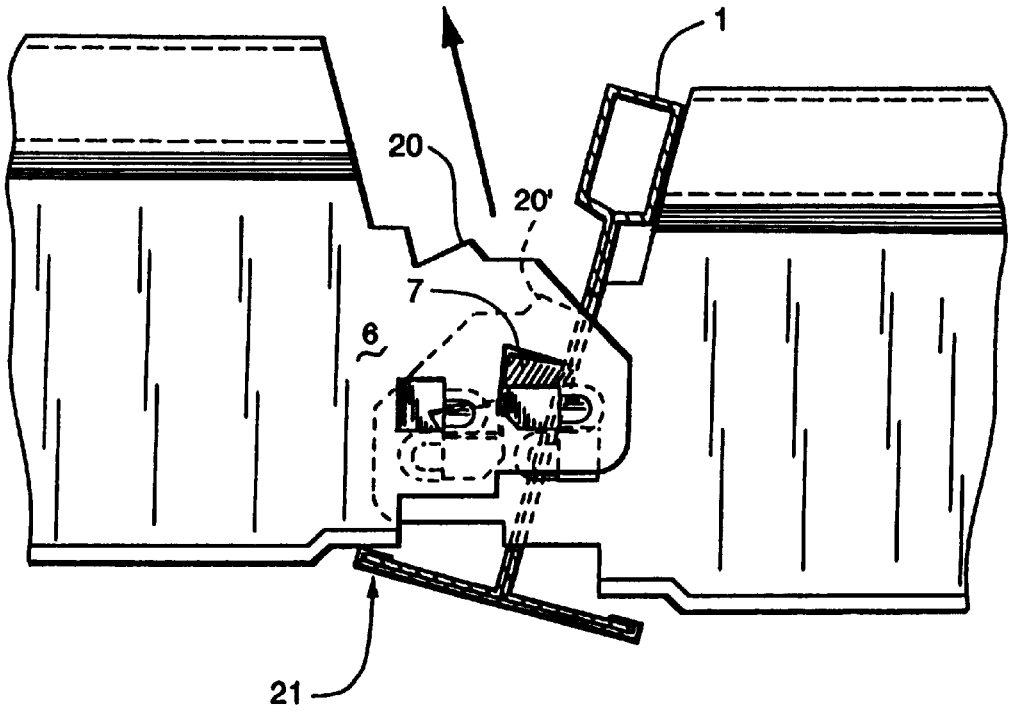
FIG. 7 is a side view showing disassembly.

The second step in cross runner 2 removal is to rotate the main runner 1 over the depressed resilient finger 7 until it is in the position shown in FIG. 7. Note item 20 and 20' is an interference point which is intended to further deter an unintentional rotation, as seen. This rotation of about 15 to 25 degrees should require a small amount of force but not more than most people could accomplish comfortably with one hand. FIG. 7 also shows the outside geometry of the cross runner end. This was determined to accommodate main runner 1 rotation. Only the metal necessary to permit the rotation was removed. This design leaves a maximum amount of web metal in place to strengthen the connector 6 end from shipping and handling damage.

The third and final step in cross runner 2 removal is to push up on the cross runner connector 6 until it is free. A manageable vertical force which is at right angles to the lock shoulders will ramp or cam the detents out of their positions within the apertures. This vertical force may be provided by the main runner flange 21 as the main runner is rotated.

Although preferred embodiments of this invention are illustrated, it should be understood that various modifications may be resorted to without departing from the scope of the invention disclosed and claimed herein.

What is claimed is:

1. In a group of component parts first capable of being assembled in the field into an intersecting connection in a ceiling grid that supports panels, and then capable of being disassembled from the connection, the group having:

a main runner (1) having a web and a web opening (5), and a pair of identical cross runners (2,2'), each of said connectors (2,2') having at an end an identical connector (6,6'), each said connector (6,6') having a stop (8,8') and a resilient finger (7,7');

wherein a) in assembling the group, each of said connectors (6,6') is inserted substantially horizontally into the web opening (5) against the stop (8,8') on the connector (6,6'), with the web vertical, in a stab motion that is relatively straight and along the longitudinal axis of the cross runner (2,2');

b) in the assembled group, each connector (6,6') is confined within the web opening, and when so confined, is interlocked with said connector (6,6') of an opposing cross runner (2,2') to prevent separation of the connectors (6, 6') longitudinally of the cross runners; and c) in disassembling the group, the main runner (1) is rotated so that one of said connectors (6,6') is no longer confined within the web opening (5) and said connector (6,6') can be removed from the assembled group substantially vertically;

the improvement comprising, each connector having (6,6'), a movable shoulder (7*a*,7*a'*) on the resilient finger (7,7') spaced away from the stop (8,8') a distance sufficient to permit the movable shoulder (7*a*,7*a'*) and stop (8,8') to straddle the web of the main runner (1) in the assembled group;

wherein a) in assembling the group, the resilient finger (7,7') is depressed as the movable shoulder passes through the web opening (5) and then the resilient finger (7,7') recovers after the movable shoulder (7*a*,7*a*') has passed through the web opening (5), and the stop (8,8') is against the web;

b) in the assembled group, the movable shoulder (7*a*, 7*a*') and the stop (8,8') on each connector (6,6') combine with the movable shoulder (7*a*,7*a*') and the stop (8,8') on the other connector (6,6') to straddle the web and maintain the web in a vertical position against rotation, whereby the connectors (6,6') are confined within the web opening (5) and each connector (6,6') is kept interlocked laterally and longitudinally with the other connector (6,6'); and c) in disassembling the group, the resilient finger (7,7') must be depressed to permit the web opening to pass over the movable shoulder (7*a*,7*a*') when the main runner is rotated.

2. The group of claim 1, wherein the connector on a cross runner is formed from the cross runner.

3. The group of claim 1, wherein each of the connectors on said cross runners is in the form of a clip attached to the cross runner.

4. The group of claim 1, wherein each of said connectors has at least one interference point to prevent unintentional rotation of the main runner web from a vertical position during assembly.

5. The group of claim 1, wherein each of said connectors has at least one interference point to prevent unintentional rotation of the main runner from a vertical position during assembly of the connection and when the connection is assembled.

6. In a process, a group of component parts first capable of being assembled in the field into an intersecting connection in a ceiling grid that supports panels, and then capable of being disassembled from the connection, the group having:

a main runner (1) having a web and a web opening (5), and a pair of identical cross runners (2,2'), each of said connector (2,2') having at an end an identical connector (6,6'), each said connector (6,6') having a stop (8,8') and a resilient finger (7,7');

wherein a) in assembling the group, inserting a connector substantially horizontally into the web opening (5) against the stop (8,8') on the connector (6,6'), with the web vertical, in a stab motion that is relatively straight and along the longitudinal axis of the cross runner (2,2');

b) in the assembled group, confining each connector (6,6') within the web opening, and when so confined, is interlocked with the other connector (6,6') to prevent separation of the connectors (6, 6') longitudinally of the cross runners; and c) in disassembling the group, rotating the main runner so that one of said connectors (6,6') is no longer confined within the web opening (5) and said one of said connectors (6,6') can be removed from the assembled group substantially vertically;

the improvement comprising, on each connector (6,6'), a movable shoulder (7*a*,7*a*') on the resilient finger (7,7') spaced away from the stop (8,8') a distance sufficient to permit the movable shoulder (7*a*,7*a*') and stop (8,8') to straddle the web of the main runner (1) in the assembled group;

wherein a) in assembling the group, depressing the resilient finger (7,7') as the movable shoulder passes through the web opening (5) and then the resilient finger (7,7') recovers after the movable shoulder (7*a*,7*a*') has passed through the web opening (5), and the stop (8,8') is against the web;

b) in the assembled group, maintaining the web in a vertical position against rotation, by positioning the movable shoulder (7*a*, 7*a*') and the stop (8, 8') on each connector (6, 6') with the movable shoulder (7*a*, 7*a*') and the stop (8, 8') on the other connector (6, 6'), so that the stop and movable should on each connector straddle the web, whereby the connectors (6, 6') are confined within the web opening (5) and each connector (6, 6') is kept interlocked laterally and longitudinally with the other connector (6, 6') combine with the movable shoulder (7*a*,7*a*') and the stop (8,8') on the other connector (6,6') to straddle the web and maintain the web in a vertical position against rotation, whereby the connectors (6,6') are confined within the web opening (5) and each connector (6,6') is kept interlocked laterally and longitudinally with the other connector (6,6'); and c) in disassembling the group, depressing the resilient finger (7,7') to permit the web opening to pass over the movable shoulder (7*a*,7*a*') when the main runner is rotated.

7. The process of claim 6, wherein the connector on a cross runner is formed from the cross runner.

8. The process of claim 6, wherein the connector on a cross runner is in the form of a clip attached to the cross runner.

9. The process of claim 6, wherein each of said connectors has at least one interference point to prevent unintentional rotation of the main runner web from a vertical position during assembly.

10. The process of claim 6, wherein each of said connectors has at least one interference point to prevent unintentional rotation of the main runner from a vertical position during assembly of the connection and when the connection is assembled.

* * * * *

UNITED STATES PATENT AND TRADEMARK OFFICE

CERTIFICATE OF CORRECTION

PATENT NO. : 6,178,712 B1
DATED : January 30, 2001
INVENTOR(S) : Gale E. Sauer

It is certified that error appears in the above-identified patent and that said Letters Patent is hereby corrected as shown below:

Column 4,
Line 41, at the beginning thereof, before "(2,2)", delete "connectors" and insert -- cross runners --.
Line 62, after "connector" insert -- (6,6') --.
Line 63, at the beginning thereof, delete "6,6'"

Column 5,
Line 42, at the beginning thereof, before"(2,2')", delete "connector", first occurrence, and insert -- cross runners --.

Column 6,
Line 25, delete "should" and insert -- shoulder --.
Lines 29 to 36, delete "combine with the movable shoulder (7*a*,7*a*') and the stop (8,8') on the other connector (6,6') to straddle the web and maintain the web in a vertical position against rotation, whereby the connectors (6,6') are confined within the web opening (5) and each connector (6,6') is kept interlocked laterally and longitudinally with the other connector (6,6')"

Signed and Sealed this

Twenty-seventh Day of August, 2002

*Attest:*

*Attesting Officer*

JAMES E. ROGAN
*Director of the United States Patent and Trademark Office*